US010890089B2

(12) United States Patent
Lewis

(10) Patent No.: US 10,890,089 B2
(45) **Date of Patent: *Jan. 12, 2021**

(54) POSITIVE CRANKCASE EVACUATION DEVICE

(71) Applicant: Tracy George Lewis, Palmetto, FL (US)

(72) Inventor: Tracy George Lewis, Palmetto, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/829,751

(22) Filed: Mar. 25, 2020

(65) Prior Publication Data

US 2020/0224566 A1 Jul. 16, 2020

Related U.S. Application Data

(63) Continuation of application No. 15/060,832, filed on Mar. 4, 2016, now Pat. No. 10,619,536.

(60) Provisional application No. 62/104,400, filed on Jan. 16, 2015.

(51) Int. Cl.
*F01M 13/04* (2006.01)

(52) U.S. Cl.
CPC ..... *F01M 13/04* (2013.01); *F01M 13/0405* (2013.01); *F01M 2013/0433* (2013.01); *F01M 2013/0438* (2013.01)

(58) Field of Classification Search
CPC ..... F01M 13/04; F01M 13/0405; F01M 2013/0433; F01M 2013/0438
See application file for complete search history.

(56) References Cited

U.S. PATENT DOCUMENTS 4,409,950 A * 10/1983 Goldberg ..... F01M 13/022 123/572

* cited by examiner

*Primary Examiner* — Jacob M Amick
*Assistant Examiner* — Charles Brauch
(74) *Attorney, Agent, or Firm* — Stanton IP Law Firm, P.A.

(57) ABSTRACT

A PCED can include an outer can, an upper lid having an upper lid intake and an upper lid exhaust, a lower lid having a lower lid exhaust, and an internal frame disposed within the can. With the internal frame disposed within the can, first, second, third, and fourth chambers can be formed, with the first chamber containing a coalescing material. Gases from a combustion engine crankcase can enter the PCED via the upper lid intake, move through the chambers, and exit the PCED via the upper lid exhaust and return to the crankcase. While moving through the chambers, impurities within the gas convert to liquid form via condensation, collect in the second chamber, and can be subsequently drained from the PCED via the lower lid exhaust.

20 Claims, 3 Drawing Sheets

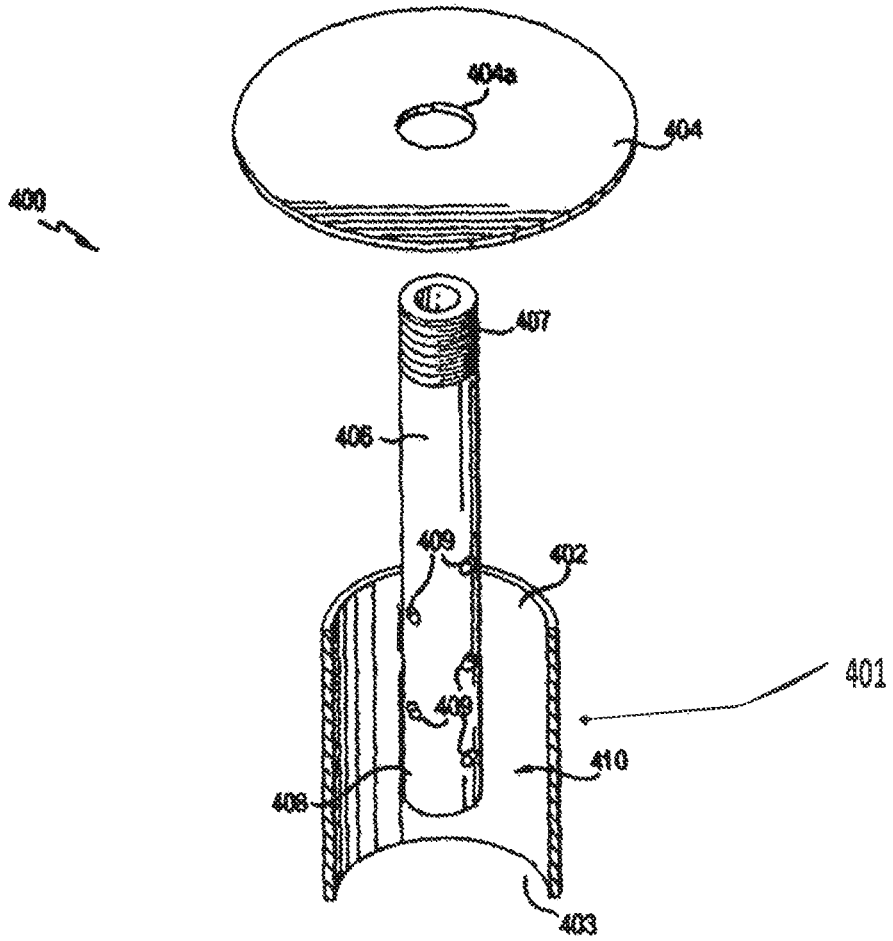
FIG. 2
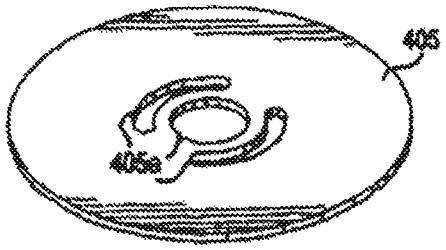

POSITIVE CRANKCASE EVACUATION DEVICE

CROSS-REFERENCE TO RELATED DOCUMENTS

This document is related to, incorporates by reference in its entirety, and claims the priority benefit of U.S. Provisional Patent Application Ser. No. 62/104,400 entitled "The RX Catch Can" filed on Jan. 16, 2015 by Tracy George Lewis. Further, this application incorporates by reference in its entirety, and claims the priority benefit of U.S. patent application Ser. No. 15/060,832 filed Mar. 4, 2016.

FIELD OF THE INVENTION

The present invention relates to combustion engines and combustion by-products within such engines, and more specifically, to devices and methods to remove such by-products during combustion engine operation.

BACKGROUND OF THE INVENTION

Combustion engines can generate energy by converting combustion forces arising from the ignition of combustible air-fuel mixture. By igniting such a mixture within a combustion chamber, a combustion force can cause mechanical motion of a structure, such as a piston, which can then be converted to power.

A crankcase ventilation system allows gases to escape from the crankcase of an internal combustion engine, and is generally required, as during combustion events an amount of "blow-by" arises when a portion of combustion gases escape past piston rings and reach the inside of a crankcase. This results in undesired pressures, as well as combustion by-products, in the crank case. Accordingly, positive crankcase ventilation (PCV) is used to vent the crankcase to control such internal pressure.

SUMMARY OF THE INVENTION

An object of the present invention is to provide a positive crankcase evacuation device ("PCED").

Another object of the present invention is to provide a positive crankcase evacuation device that can assist in removing contaminants within a crankcase.

In an exemplary embodiment of the present invention, a positive crankcase evacuation device can include an outer can, an upper lid, a lower lid, an internal frame and an amount of coalescing material.

In an exemplary aspect of the present invention, an outer can have at least one side can wall, with the at least one side can wall defining an open can top, an open can bottom, and a can cavity.

In another exemplary aspect, an upper lid, which can be removable or permanently attached to the can top or integral therewith, can have at least one upper lid intake aperture and at least one upper lid exhaust aperture.

In a further exemplary aspect, a lower lid, which can be removable or permanently attached to the can bottom or integral therewith, can have at least one lower lid exhaust aperture for draining trapped contaminants.

In still another exemplary aspect, an internal frame can be disposed within the can cavity, and can have the following:

at least one frame side wall defining an open frame top and an open frame bottom, a first baffle, attached to the frame top, and having at least one first baffle aperture, a second baffle, attached to the frame bottom, and having at least one second baffle aperture, and an intake conduit, extending through the first baffle aperture, and having a first conduit end in communication with the upper lid intake aperture, and a second conduit end in direct communication with a first chamber, the first chamber defined by said internal frame sidewall, the first baffle, and the second baffle, wherein the conduit can include a cylindrical conduit having at least one radial perforation.

In still a further exemplary aspect, an amount of coalescing material can be disposed within the first chamber.

in still yet another exemplary aspect, the lower can lid, second baffle, and at least one side can wall define a second chamber, the at least one side can wall, the first baffle, and the second baffle can define a third chamber, and the at least one side can wall, the first baffle, and the upper can lid form a fourth chamber.

In an exemplary application of the present invention, impurity-containing gases from a crankcase can enter the PCED via the first conduit end, and thereafter enter the first chamber via the second conduit end. Next, the gases can travel through the coalescing material, which can cause at least a portion of the impurities to convert to liquid form via condensation. The liquid can then drain downward through the at least one second baffle aperture and collect in the second chamber, which can be subsequently drained via the lower lid exhaust aperture, which can be selectively opened or closed.

Further, the gases in the first chamber can then enter the second chamber, in which further condensation can occur before traveling upwardly between the at least one can side wall and edges of the second baffle to enter the third chamber, in which additional condensation can occur. Next, the gases can again travel upwardly between the at least one can side wall and edges of the first baffle to enter the fourth chamber, in which still further condensation can occur. Finally, gases can exhaust the PCED via the at least one upper lid exhaust aperture and be returned to a crankcase.

BRIEF DESCRIPTION OF THE DRAWINGS

FIG. 2 illustrates an exemplary frame 400 having at least one frame side wall 401, a first baffle 404, and a second baffle 405, and holes 405*a*, as best seen in FIG. 2, are for draining fluid down.

DETAILED DESCRIPTION

It is an object of the present invention to provide a positive crankcase evacuation device.

It is another object of the present invention to provide a positive crankcase evacuation device that assists in removing impurities from within a crankcase.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of a patentable invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and./or aspects, independently or in any combination of one or more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore any explicit, implicit, or apparent benefit from the disclosure herein is expressly deemed as applicable to the present invention.

The present invention provides a positive crankcase evacuation device ("PCED").

In an exemplary embodiment of the present invention, a PCED can include an outer can, an upper lid, a lower lid, an internal frame, and an amount of coalescing material.

Figure 1:
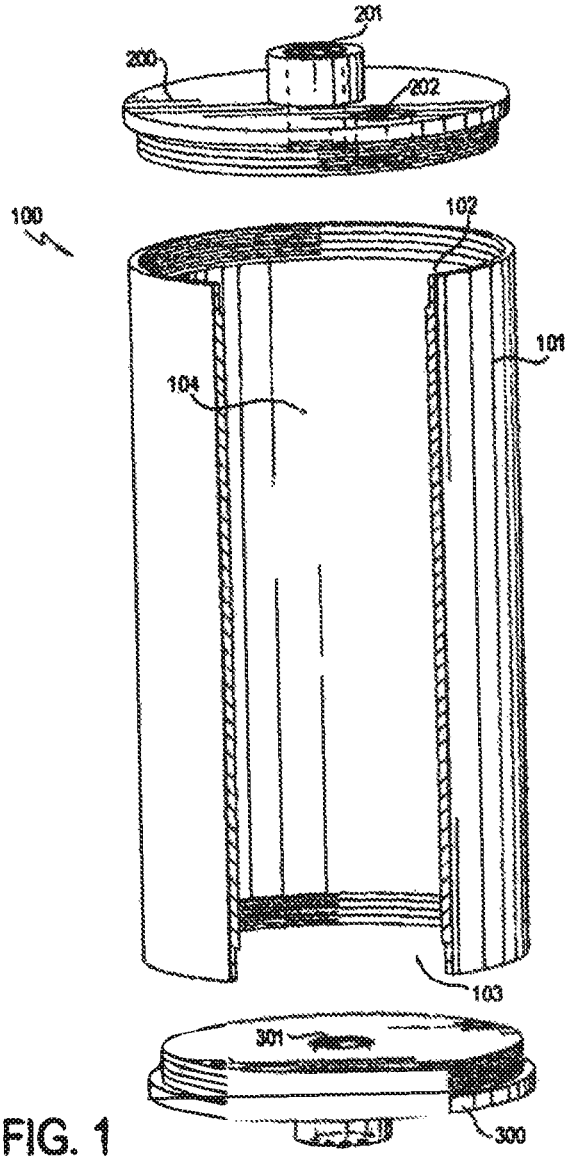
FIG. 1 illustrates an exemplary outer can 100, an upper lid 200, and a lower lid 300.

As illustrated in FIG. 1, and outer can 100 have at least one side can wall 101 that can define an open can top 102, at open can bottom, 103, and a can cavity 104. Notably, can 100 is illustratively shown as having a cylindrical shape, but can be provided with any particular shape or shapes desired, such as any one or more geometric and/or irregular shape(s).

In an exemplary aspect, upper lid 200 can include at least one upper lid intake aperture 201 and at least one upper lid exhaust aperture 202. Notably, upper lid 200 can be configured to be removably attached to can top 102, such as via threads, for example and not in limitation, or be permanently attached thereto, via welding, adhesive, etc., or can be integral therewith, such as via molding or other type of forming.

In another exemplary aspect, lower lid 300 can include at least one lower lid exhaust aperture 301. Notably, lower lid 300 can be configured to be removably attached to can bottom 103, such as via threads, for example and not in limitation, or be permanently attached thereto, via welding, adhesive, etc., or can be integral therewith, such as via molding or other type of forming.

As illustrated in FIG. 2, internal frame 400 can include at least one frame side wall 401 that defines an open frame top 402 and an open frame bottom 403. Notably, frame side wall 401 is illustratively shown as having a cylindrical shape, but can be provided with any particular shape or shapes desired, such as any one or more geometric and/or irregular shape(s).

As further illustrated, internal frame 400 can further include a first baffle 404 attached to frame top 402 and having at least one first baffle aperture 404*a*, and a second baffle 405, attached to frame bottom 403, and having at least one second baffle aperture 405*a*. Notably, first and second baffle 404, 405 can be configured to be removably attached to frame top and bottom 402, 403, such as via threads, for example and not in limitation, or be permanently attached thereto, via welding, adhesive, etc., or can be integral therewith, such as via molding or other type of forming.

As further illustrated, internal frame 400 can also include an intake conduit 406 that extends through first baffle aperture 404*a*, and can have a first conduit end 407 n communication with the upper lid intake aperture 201 (shown in FIG. 3), and a second conduit end 408 in communication with a first chamber 410 defined by internal frame sidewall 401, first baffle 404, and the second baffle 405. Also, second conduit end can be provided with at least one second conduit end aperture 409, which can be centrally-located through intake conduit 406 and/or provided at any one or more points along the intake conduit.

As further illustrated, an amount of coalescing material 500, which can be provided as any desired material that can facilitate condensation as described herein, including any one or more of a metallic, plastic, rubber, wood, crystalline, naturally occurring or man-made material, for example and not in limitation, can be disposed within first chamber 410. In an exemplary embodiment, coalescing material can be provided as a "shredded metal", such as stainless steel mesh, for example and not in limitation.

Figure 3:
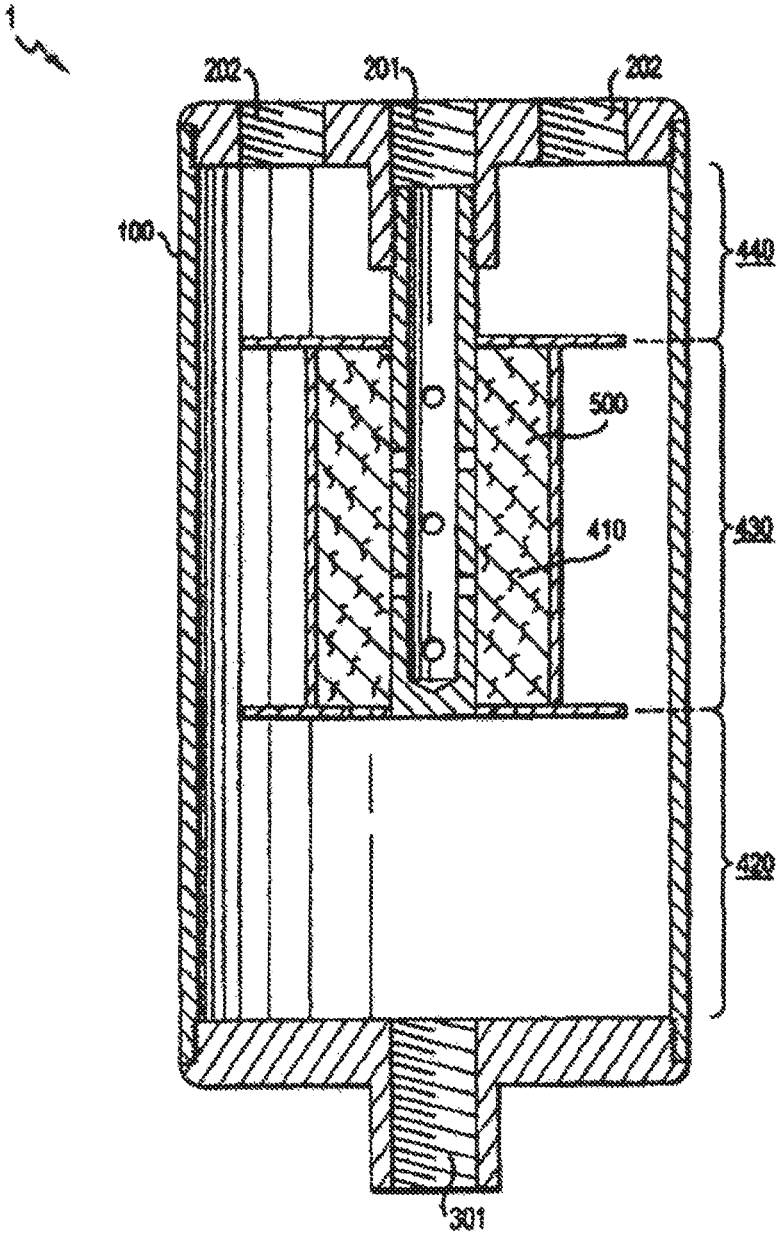
FIG. 3 illustrates an exemplary positive crankcase device having an exemplary frame 400 positioned within an exemplary outer can.

FIG. 3 illustrated an exemplary PCED configured for operation, in which internal frame 400 is disposed within outer can 100, with upper and lower lids 200,300 sealably attached thereto. As illustratively shown, lower can lid 300, second baffle 405, and at least one side can wall 101 define a second chamber 420 the at least one side can wall, first baffle 404, and the second baffle define a third chamber 430; and the at least one side can wall, the first baffle, and upper can lid 200 form a fourth chamber 440.

In an exemplary operation of a PCED, impurity-containing gases from a crankcase (not shown) can enter the PCED via upper lid intake aperture 201 and first conduit end, 407, and thereafter enter first chamber 410 via the one or more second conduit end apertures 409 through perforations in conduit 406.

Next, the gases can travel through coalescing material 500, which can cause at least a portion of the impurities to convert to liquid form via condensation within first chamber 410. The liquid can then drain through the at least one second baffle aperture 405*a* and collect in second chamber 420, and can be subsequently drained via lower lid exhaust aperture 301, which can be selectively opened or closed, in any functionally compatible manner and/or with any functionally compatible structure desired, such as via a valve.

Further, gases in first chamber 410 can then enter second chamber 420 via the at least one second baffle aperture 405*a*, in which further condensation can occur before traveling upwardly between the at least one can side wall 101 and edges of second baffle 405 to enter third chamber 430, in which additional condensation can occur. Next, the gasses can again travel upwardly between the at least one can side wall 101 and the edges of first baffle 404 to enter fourth chamber 440, in which still further condensation can occur. Finally, gases can exhaust the PCED 1 via the at least one upper lid exhaust aperture 202, and returned to the source crankcase (not shown).

Notably, any one or more disclosed components of the present invention can formed from any one or more materials desired, including but not limited to, any type of metal (including aluminum), plastic, rubber, crystalline material, naturally occurring or man-made material, etc., insofar as the same in functionally compatible with the present invention as described.

Additionally, it should be noted that the present invention can optionally be provided with one or more positive closing check valves to self-regulate air flow, so as to minimize the risk of oil pull-through during deceleration from wide open throttle runs.

Further, outer can 100 can be provided with a one quart capacity, but can be provided with smaller or larger capacities as desired. Further, the present invention can be provided with one or more chambers to the extent desired.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention. For example, any one or more components of the present invention can be attached to another, whether permanent or removably, or can be integral therewith.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

What is claimed is:

1. A positive crankcase evacuation device, comprising:

an outer can having at least one side wall;

an upper lid having at least one upper lid intake aperture and at least one upper lid exhaust aperture;

a lower lid having at least one lower lid exhaust aperture;

an internal frame;

a first baffle, attached to the frame top, and having at least one first baffle aperture; and a second baffle, attached to the frame bottom, and having at least one second baffle aperture, and an intake conduit, extending through the first baffle aperture, and having a first conduit end in communication with the upper lid intake aperture, and a second conduit end in communication with a first chamber defined by said internal frame sidewall, the first baffle, and the second baffle, and wherein the conduit includes a cylindrical conduit having at least one radial perforation.

2. The device of claim 1, wherein the at least one side can wall defines an open can top, an open can bottom, and a can cavity.

3. The device of claim 1, wherein the internal frame is disposed within a can cavity and includes at least one frame side wall which defines an open frame top and an open frame bottom.

4. The device of claim 1, further comprising an amount of coalescing material disposed within the first chamber; wherein the lower lid, the second baffle, and the at least one side can wall define a second chamber, the at least one side can wall, the first baffle, and the second baffle define a third chamber, and the at least one side can wall, the first baffle, and the upper lid form a fourth chamber.

5. The device of claim 1, further comprising at least eight radial perforations in the cylindrical conduit.

6. The device of claim 5, wherein a diameter of the at least eight radial perforations are about 0.125 inches.

7. The device of claim 6, wherein the at least eight radial perforations are arranged in pairs of perforations.

8. The device of claim 7, wherein each of the perforations in a pair are positioned about the same axial location on the cylindrical conduit and each of the perforations in a pair are about 180 degrees circumferentially from one another on the cylindrical conduit.

9. The device of claim 8, wherein each pair of the perforations are configured to be offset 90 degrees circumferentially from the pair of the perforations above.

10. The device of claim 1, wherein the second baffle includes holes configured in a curved radial quarter moon shape structured to disperse fluids downward.

11. The device of claim 1, wherein a uniform radial clearance distance is formed between an outer surface of the first and second baffles and an inner surface of the side can wall.

12. The device of claim 1, further comprising a handle.

13. The device of claim 1, wherein the outer can includes a transparent material.

14. The device of claim 1, further comprising at least one positive closing check valve arranged to self-regulate air flow.

15. The device of claim 1, further comprising a plurality of chambers of at least four chambers.

16. The device of claim 15, wherein the plurality of chambers are separate.

17. The device of claim 1, wherein the outer can provides a volume of at least one quart.

18. The device of claim 1, wherein the second baffle is positionable within the device about ⅔ of an overall distance of the device from the upper lid.

19. The device of claim 1, wherein a distance between the first baffle and the second baffle is about 28 percent of an overall length of the device.

20. The device of claim 1, wherein the lower lid exhaust aperture is selectively opened or closed.

* * * * *